US009013112B2

(12) United States Patent
Davoodabadi et al.

(10) Patent No.: US 9,013,112 B2
(45) Date of Patent: Apr. 21, 2015

(54) POWER EFFICIENT DRIVING CIRCUITS OF LIGHT SOURCE FOR PROJECTORS

(76) Inventors: Mahdi Davoodabadi, Irvine, CA (US); Nick Nianxiong Tan, Laguna Niguel, CA (US)

( * ) Notice: Subject to any disclaimer, the term of this patent is extended or adjusted under 35 U.S.C. 154(b) by 585 days.

(21) Appl. No.: 13/284,138

(22) Filed: Oct. 28, 2011

(65) Prior Publication Data

US 2012/0326621 A1 Dec. 27, 2012

Related U.S. Application Data

(60) Provisional application No. 61/455,896, filed on Oct. 28, 2010.

(51) Int. Cl.
*H05B 37/02* (2006.01)
*H05B 33/08* (2006.01)

(52) U.S. Cl.
CPC ..... *H05B 33/0815* (2013.01)

(58) Field of Classification Search
USPC ..... 315/209 R, 224–226, 291, 307, 308, 283
See application file for complete search history.

(56) References Cited

U.S. PATENT DOCUMENTS 8,692,473 B2 * 4/2014 West ..... 315/200 A
2009/0315471 A1 * 12/2009 Rowland ..... 315/224

* cited by examiner

*Primary Examiner* — Jimmy Vu

(57) ABSTRACT

A system for driving current to the light source may include a first inductor to supply current to the light source, a power source to supply current to the inductor, a first switch SET to supply current to the inductor without supplying the current to the light source and a second switch SET to supply the current from the inductor to the light source. Also a system for driving current to light source may include two inductors or a transformer, to supply current to the light source by connecting the first inductor to the light source by a switch set, while the second inductor may be connected to the voltage source by another switch set. And this role can be exchanged between the two inductor alternately and in sequence, defined by time periods.

17 Claims, 6 Drawing Sheets

POWER EFFICIENT DRIVING CIRCUITS OF LIGHT SOURCE FOR PROJECTORS

PRIORITY

The present invention claims priority under 35 USC section 119 and based upon a provisional application with a Ser. No. 61/455,896 and with a filing date of Oct. 28, 2010.

BACKGROUND

For pico projectors that are used in portable devices like cell phones or other devices, power dissipation is important. Pico projectors may be of any type such as liquid crystal on silicon (LCOS), digital light processing (DLP), and scanning-mirror system (March of the Pico Projectors, IEEE Spectrum, May 2010) or other similar devices. In all of the systems, there is a light source which may use either LEDs or LDs (laser Diodes). Lighting LEDs or LDs and these light sources usually may be the most power hungry blocks of a pico projector.

Traditionally, a light source may be driven by using a DC/DC converter, and there are different types of DC/DC converters being used such as Buck, Boost or Buck-Boost converters. One of the widely used is the Buck-Boost converter. Such a circuit is shown in the FIG. 1.

The Buck Boost converter may include an error amplifier, a pulse width modulator (PWM), an off-chip inductor and a divider network. The principle of the Buck Boost converter is well known. Basically, the battery charges the inductor on clock phase Φ1, and on clock phase Φ2, the energy is transferred from the inductor L to the capacitor C (Notice that the switching sequence can be different depending on the Buck, Boost, or Buck-boost type of the converter.). The external resistor ladder determines the output voltage by a feedback that consists of an error amplifier and a PWM. Due to the feedback, we have:

$$V_{out\ X}(R_2)/(R_1+R_2)=\text{Vref}$$

The light source is usually current driven. The voltage across the light source differs for different types of light sources. A current sink that is controlled by a digital to analog converter (DAC) is usually used to regulate the current into the light source.

The minimum output voltage has to be larger than the voltage drop across the light source and that across the current source. It is obvious that the power efficiency of the device suffers due to the voltage needed for the current source. Another issue is to share single DC/DC converter to drive several LEDs or LDs (e.g., for red, blue, and green). Those LEDs or LDs have different voltage drops. If the DC/DC converter output voltage is set too high, the efficiency drops significantly when driving the light source having a lower voltage drop. Techniques may be used to dynamically adjust the DC/DC converter output voltage according to the light source voltage drop by changing the feedback ratio around the DC-DC converter. The problem with these techniques is the large ringing and the long settling time in the DC/DC converter when we adjust the output voltage. Large settling time results in the loss of efficiency. The color accuracy also suffers from the large rise/fall time as the current source (sink) has a finite output impedance and while settling. Due to the finite output impedance in the current sink, the current into the light source changes as the voltage drop is changing. Of course, this still cannot solve the efficiency issue related with the voltage headroom of the current source even after settling.

Even if only one single DC-DC converter is dedicated to the Light Source, The voltage drop across the Light Source is a function of its current, so it is changing when the current changes. So we have to adjust the output of the DC-DC converter accordingly, to minimize the voltage drop, hence saving power. Or if the DC-DC converter output is constant, lower efficiency results due to extra voltage on the current driver which is not needed.

SUMMARY

A system for driving current to the light source may include a first inductor to supply current to the light source, a power source to supply current to the inductor, a first switch to supply current to the inductor without supplying the current to the light source and a second switch to supply the current from the inductor to the light source.

The system may include a pulse width modulator to control the first switch and the second switch.

The system may include an integrator to connect to the pulse width modulator.

The power source may be a battery.

The light source may cooperate with a photo diode.

The photo diode may be coupled to the integrator.

The integrator may be an averaging circuit.

A system for driving current to the light source may include a first inductor to supply current to the light source during the first time period, a second inductor to supply current to the light source during a second time period, a power source to supply current to the inductor, a first switch to supply current to the inductor without supplying the current to the light source and a second switch to supply the current from the inductor to the light source.

DETAIL DESCRIPTION

Figure 1:
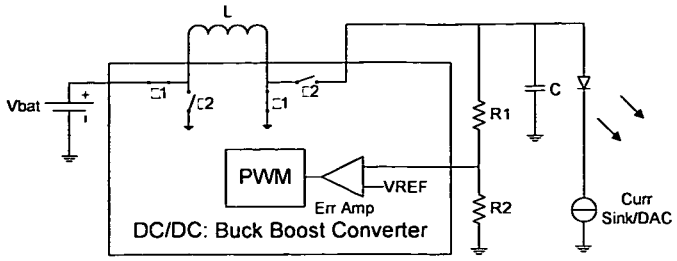
Fig. 1 (Prior Art)
FIG. 1 illustrates a DC/DC converter driving a light source.
Figure 2A:
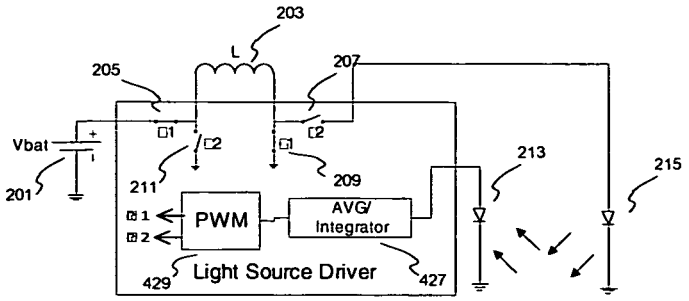
FIG. 2A illustrates a circuit for driving a light source of the present invention.
Figure 2B:
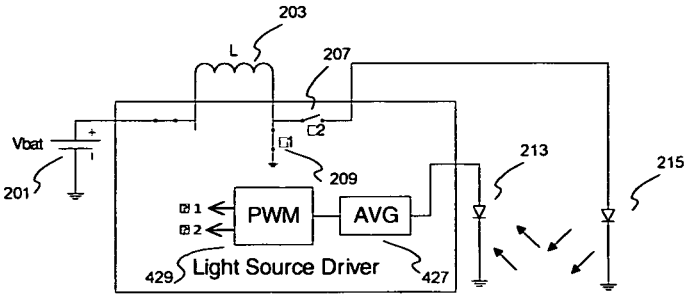
FIG. 2B illustrates another circuit driving a light source of the present invention.

In pico projectors, the light sources of LEDs or LDs do not have to be driven by a constant current. Human eyes may behave like a low-pass filter. Therefore, the driving current to the light source can be on and off at a frequency higher than a certain threshold without human eyes detecting the flickering of the sources. Those two observations lead to aspects of the present invention. Two circuits are shown in FIG. 2A and FIG. 2B. FIG. 2B illustrates a circuit with a fewer number of switches and the pulse width modulator is connected to the switches in order to provide the signals Φ1, Φ2.

The voltage source 201 which may be a battery may be connected to and may drive an inductor 203 (the inductor 203 could be internal (on-chip) or external (off-chip) depending on the switching frequency and the inductance value of the inductor 203) on a first clock phase (period) Φ1, in the same fashion as in a DC/DC Buck Boost converter. The pulse width modulator circuit (PWM) 429 generates the pulse signals Φ1, Φ2 which may be used to operate the first switch 205, the second switch 207, the third switch 209 and the fourth switch 211. For simplicity, the connection to the various switches may not be shown. During the first clock phase Φ1 the first switch 205 is closed to connect the voltage source 201 to the inductor 203. The third switch 209 is closed: the second switch 207 is open and the fourth switch 211 is open during the first clock phase Φ1. During the second clock phase Φ2, the first switch 205 is open; the second switch 207 is closed connecting the inductor 203 to the diode 215; the third switch 209 is open and the fourth switch 211 is closed, to conduct the current of inductor 203 to the diode 215. On clock phase Φ2, the inductor 203 directly drives the light source 215. The light source 215 may activate the photo diode 213 by the light from the light source 215, and the photo diode 213 may be connected to the average integrator 427 which may be connected to the PWM 429. It's There are several differences between the invention and a Buck-Boost converters.

In the invention, there is no external large capacitor nor a current source that regulates the current into the light source.

Figure 3:
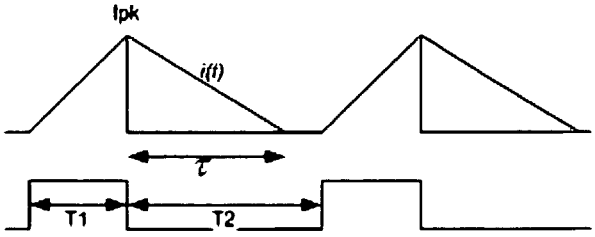
FIG. 3 illustrates a graph illustrating the operation of the present invention.

With the present invention, the current in the light source is no longer a constant current, but decreases with time on clock phase Φ2. Even though the decrease of the current may not be a linear function of time, for simplicity, the present invention may use a linear function to explain the operation as shown in FIG. 3.

On clock phase Φ1 which closes switch 205 and switch 209 which opens switch 207 and switch 215, the voltage source 201 which may be a battery charges the inductor L 203 with a predetermined interval T1. The current through the inductor 203 increases linearly with the peak current given by $$I_{pk}=(\text{Vbat}/L)*T1$$

Where Vbat is the battery voltage or the source voltage 201, L may be the inductance of the inductor 203, and T1 is the time interval when Φ1 is in effect. Obviously, the peak current may be adjusted by one of or a combination of the battery voltage, the inductance value, and the time interval T1 within which the inductor 203 is charged.

On clock phase Φ2 which may open the switch 205 and the switch 209 and which may close the switch 207 and the switch 211, the pre-charged current of the inductor 203 discharges thru the light source 215, so the energy will convert to light. The characteristic of the discharge current i(t) depends on many factors associated the light source. Although shown in the FIG. 3 may be a linear discharging function, in reality, the discharging function i(t) may be quite nonlinear. The time interval when the discharging current becomes substantially zero is denoted as r(Taw in FIG. 3). If within clock phase Φ2, the discharging current is still not zero, r (Taw in FIG. 3) becomes the maximum time available T2.

In the present invention, instead of driving a constant current into the light source 215, the present invention drives a current that is a function of time. On clock phase Φ1, the current into the light source 215 is substantially zero, and on clock phase Φ2, the current may begin at the peak value Ipk and gradually decreases while driving the light source 215. The one factor here is the average current thru LD. We are only concerned with the average current. And the average current seen by the light source 215 during T2 is given by (assuming no loss in switching)

$$I_{avg}=\int_0^{taw} I(t)\cdot dt/(T1+T2)$$

As long as Iavg is close to the constant current in prior art, the light source can be lit without much difference observed by human eyes given the time intervals T1 and T2 are small.

FIG. 3 illustrates the relationship between T1 and $I_{pk}$ and i(t).

Figure 4:
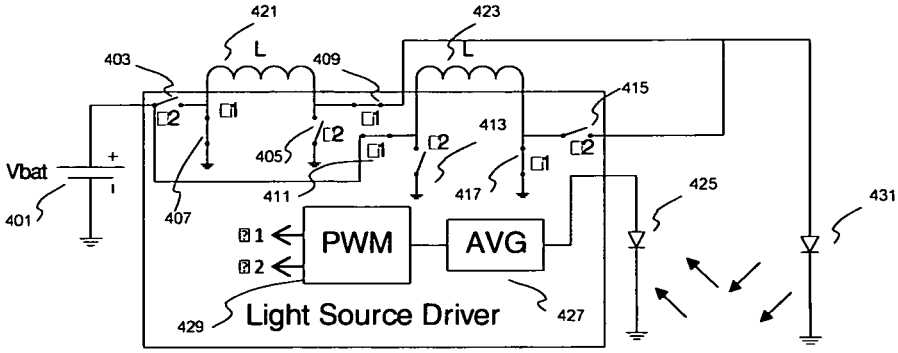
FIG. 4 illustrates another circuit for driving a light source of the present invention.

Iavg may be smaller than Ipk. To improve this, the present invention may use one or multiple inductors connected such that on both clock phases Φ1, Φ2, there is current driving to the light source. The result of using multiple inductors may increase the average current to the light source. Such an invention is shown in the following figure (FIG. 4). Note that a transformer can be used instead of two separate inductors. Transformer is in fact the two inductors where they share the magnetic core/field and it makes whole system more efficient while it calls for a single package and hence reducing the costs. See FIG. 4.

FIG. 4 illustrates s driving circuit 400 which may include voltage source 401 which may be a battery and which may be connected to a switch 411 which may be closed during the first time period Φ1 and may be connected to the second inductor 423. At the same time period Φ1 the switch 417 may be connected to inductor 423 and may be closed to charge this inductor with current. During same time period Φ1 the switch 407 which may be connected to first inductor 421 may be closed to connect this inductor to ground. At the same time period Φ1, the first inductor 421 may be connected to the switch 409 which may be closed to connect the first inductor 421 to the light source 431. So during time period Φ1 the first inductor 421 may be driving current to light source 431, while the second inductor 423 may be connected to battery 401 to be charged by current.

During time period Φ1 switch 403 which may be connected to inductor 421 will remain open circuit. Also switch 405 which may be connected between ground and inductor 421 will stay open circuit. Also switch 413 which may be connected between ground and second inductor 423 will stay open circuit, and switch 415 which may be connected between light source 431 and second inductor 423 will stay open circuit.

During time period Φ2 which may be non-overlap in time, respect to time period Φ1, or may be opposite polarity respect to Φ2, the role of first inductor 421 and second inductor 423 will be exchanged. During time period Φ2 voltage source 401 which may be a battery and which may be connected to a switch 403 which may be closed during the second time period Φ2 and may be connected to the first inductor 421. At the same time period Φ2 the switch 405 which may be connected between ground and first inductor 421 may be closed to start charging inductor 421 thru voltage source 401. At the same time period Φ2 the switch 413 which may be connected between ground and second inductor 423, may be closed. Also the switch 415 which may be connected between light source 431 and second inductor 423 may be closed so the current of second inductor 423 can go thru light source 431.

The pulse width modulator 429 may generate the signals Φ1, Φ2 and control the switches 401, 403, 405, 407, 409, 411, 413, 415 and 417. The light source 431 may activate a photo diode 425 which may be connected to an averaging circuit 427, which may be connected to a PWM 429. The averaging circuit 427 can calculate the average of the current over the period of time and compare it against a predefined value to control PWM 429, to control the duration of each of the time periods Φ1 and Φ2.

To use the circuit for pico projectors, the average current may be regulated. There are two ways to achieve this regulation of the average current. One way is the open loop and the other is feedback loop.

The open loop control can be obtained based on characteristics of the light source, because the average current into the light source may be determined before-hand by switching the pre-charged inductor into load. Such a system may operate based on a look up table. This control is less precise than using feedback. More precise control involves a feedback. We can use a photo diode set 425 (PD) (FIG. 2A and FIG. 2B show this as element 213) to sense the light that is generated by the light source from the projector. The light sensitive PD 425 generates a current proportional to the light emitted from the light source and so is proportional to the current driven into the light source. The present invention may integrate or average the current from the diode 425 by the averaging circuit 427 and use the integration as a control signal to the pulse width modulator 429, PWM, to precisely control the total current sent to the light source 431 over a period of time as disclosed in FIGS. 2A 2B, 4, 5 and 6.

In these figures, it is evident that the present invention operates differently than a DC/DC converter due to the absence of large external capacitor that is used as a charge reservoir, and due to missing error amplifier to regulate the output voltage. Furthermore, the present invention does not generate other DC voltages here as a regulated output. The present invention does not require a current source to regulate the current driving to the light source. The present invention eliminates the voltage overhead for the current source, improving the efficiency. Due to the absence of large capacitor, a time-interleaving scheme for driver circuit becomes easy task to implement and faster. The absence of the large capacitor may eliminate ringing or settling time issue as in DC-DC converters while trying to adjust the output voltage for different LEDs/LDs, and or different current levels. Operating a multitude of light sources by turning on/off in time-interleaving scheme is achieved by adding additional switches in the system above. So obviously the present invention may eliminate duplicating the driving current sources as many as the light sources in the system (like in the conventional schemes). Additionally, the present invention may eliminate the need of big external capacitors which may be bulky and expensive. The present invention achieves this system which may be smaller and needs less hardware to implement and therefore cheaper.

Due to the absence of the large capacitor, the switching frequency can be high which makes it possible to share the driving circuits for different light sources. The present invention can be used in scanning projectors in which we target every single pixel of the frame with different level of light energy (or illumination). Because at the higher speeds the inductor value decreases, the inductor can be fabricated on silicon chips for scanning projectors for high speed applications. Besides the advantage of power efficiency, the present invention may also decrease the inductor value, achieving integration of the inductor inside a microchip.

Figure 5:
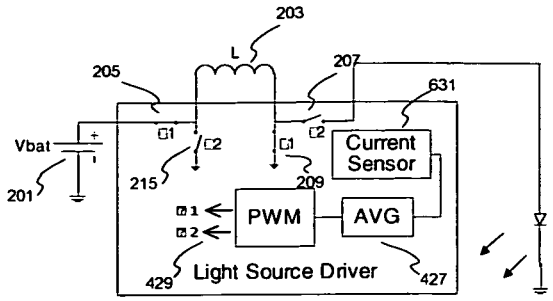
FIG. 5 illustrates a another circuit for driving a light source of the present invention.
Figure 6:
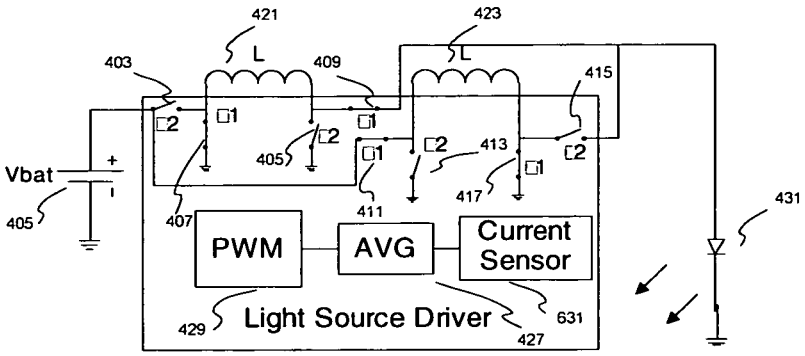
FIG. 6 illustrates a another circuit for driving a light source of the present invention.

The feedback can also be accomplished by using a current sensing circuit 631 inside the chip instead of using a PD. This is shown in FIG. 5 and FIG. 6.

For frame based systems and RGB projectors, the present invention may adjust Ipk thru Ti time such that the current Iave is met. However the present invention may also have a different scheme as summarized below. See FIG. 7 and FIG. 8.

Figure 7:
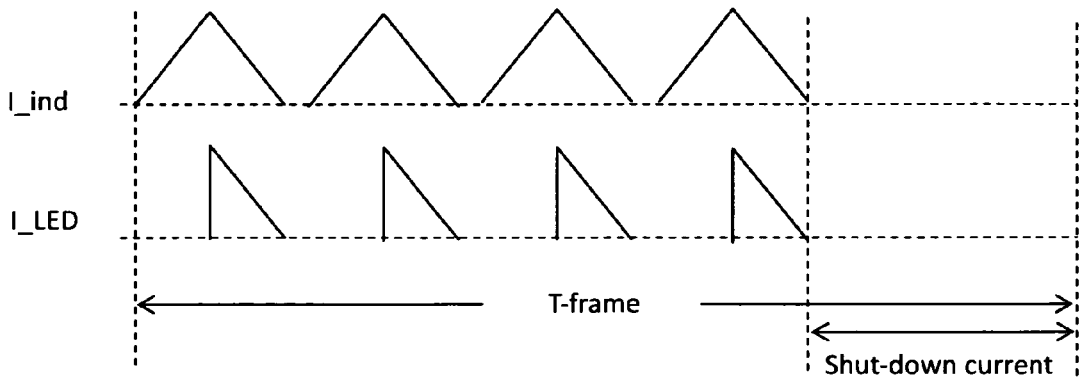
FIG. 7 illustrates the output current thru light Source when the average current is sensed and met the target.
Figure 8:
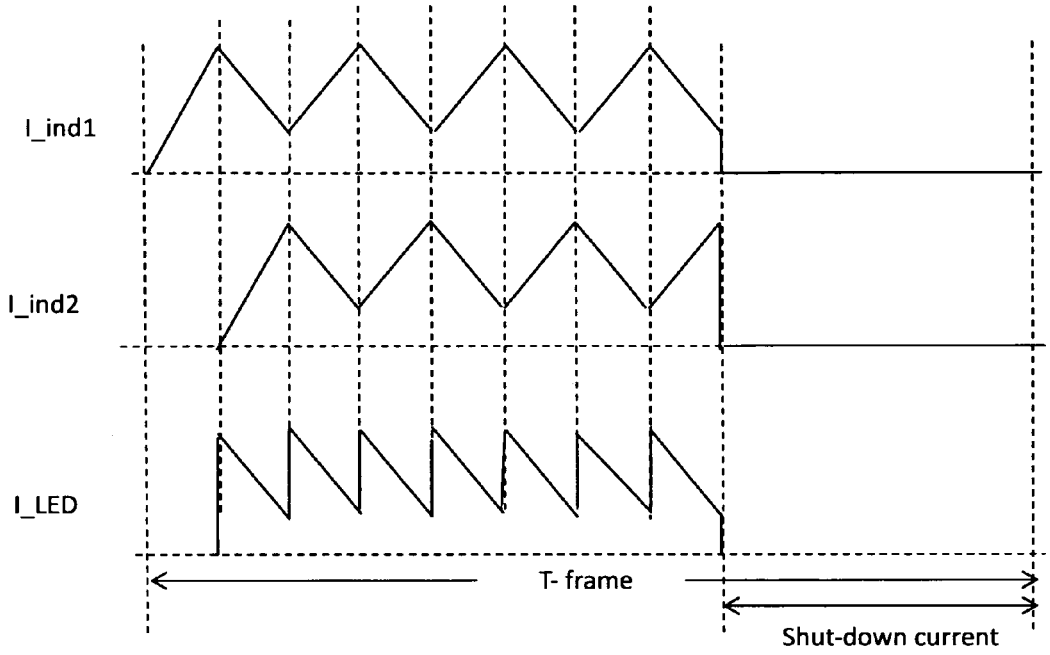
FIG. 8 illustrates the operation of the circuit with two inductors.

The present invention may start pushing the current $I_{max}$ into the load but after few cycles, that the average current, Iave for whole frame time is met, the present invention may stop switching the current into the load for the rest (a portion) of the frame like FIGS. 7 and 8.

In fact the present invention may digitize the output current, $I_{ave}$, into a multitude of levels in the whole system. So the present invention may define the accuracy of the light source, and the output color, with a certain resolution.

For simplicity let us assume that the total frame time, Tframe, is equal to e.g. 1024 cycles of T1+T2, so we will have a resolution of almost 10-bit to control the current Iave by the following scheme.

DAC=1:Push current in 1 cycle of total time "T1+T2" (out of 1024 of them)

DAC=2:Push current in 2 cycles of total time "T1+T2" (out of 1024 of them)

Etc

This can be done in an open loop fashion.

However in the system with feedback (PD or current sense) the present invention may not count the number of cycles that may be push current to the light source. Instead, the system of the present invention may average the output current and when the current $I_{ave}$ reaches the target, it will shut down the switching/$I_{out}$ for the rest of the frame time.

Notice that there are many variants that can be derived from the disclosed inventions. For example, the switch that connects the light source can be replaced by a diode.

The benefits of this invention are including but not limited to the followings:

The method of driving a light source by directly connecting to an inductor that is switched to a DC or battery source without the need to regulate the output voltage.

The current which may be driven to the light source varies with time, and the average value of the current may be determined by a preset value. So the average of the current will be regulated while the instantaneous current is not regulated by any DAC or current source. The absence of the current regulating DAC improves the efficiency because there will be no voltage drop loss on DAC driver (there is no DAC).

A scheme of driving light source with high efficiency without using conventional DC-DC converters The current which may be driven to the light source may vary with time, and the average value of the current may be regulated by a feedback that may include a Photo Diode to generate a current which is proportional to the Light Source Current. This feedback current can be integrated and averaged to regulate LED/LD current thru PWM generator.

The current which may be driven to the light source may vary with time, and the average value of the current may be regulated by a feedback that may include a current sensing circuit and current integrator as well as a PWM generator.

The method to increase the average current may include two inductors or a transformer. This switching scheme can increase the Iave/Ipk ratio in the Light Source and may be capable to drive the current non-stop and continuously to the light source.

Using two inductors or a transformer to keep the current in the light source continuously without letting the current to interrupt or to go to zero.

The present invention eliminates the need of a large Capacitor which may be used in conventional DC-DC converters resulting in a cheaper implementation.

The present invention reduces the size requirements for Integrated Microelectronic chip circuits, so making the end product cheaper.

The present invention may utilize time-interleaving such that many LEDs or LDs can share one driving circuit and/or inductors/transformer. With higher switching frequency, the present invention facilitates the integration of the inductor inside a microchip due to a smaller inductance value.

An alternative switching scheme, e.g., for the frame based Robbed bit signaling ROB systems the present invention may push the Maximum current into the load while integrating the load current by using a feedback. The present invention stops the load current whenever the output of the integrator reaches the target.

The present invention may eliminate the rise-time fall-time of conventional projectors based on DC-DC converter.

Read Green Blue RGB projectors based on DC-DC converters attempt to adjust the output voltage of the converter based on the voltage drop on Light Source. This operation may take a finite time to accomplish as the output of the DC-DC converter is designed to be constant and is connected to a large capacitor, so is difficult to change the it's voltage. During this Voltage change, rise-time or fall-time, the efficiency can be dramatically reduced. Also the current accuracy of the light source can be very poor due to the insufficient voltage to drop on light source. Also the conventional scheme based on DC-DC converter introduces a poor phase margin for the loop around the DC-DC converter that will affect the stability of the output voltage as well as light source current. This may result in ringing and oscillation, during rise or fall time and afterwards.

This invention removes the rise-time and fall-time completely as the new rise-time or fall-time is implicit for the light source. Also this invention eliminates the instabilities and ringing which is another reason to increase total efficiency.

If Laser Diodes are selected as light sources, the varying current in the light source may cause de-speckling to make the light out lasers more uniform. So this invention may help and introduce an intrinsic de-speckling for laser diodes.

The new Light Source driver described herein, may be implemented as a Micro Electronic Integrated Chip or can be implemented by using discrete components. Or it can be implemented partially by using an controlling integrated chip with discrete components.

While the foregoing description includes numerous details and specifications, it is to be understood that these are merely illustrative of the present invention, and are not to be construed as limitations. Many modifications will be readily apparent to those skilled in the art which do not depart from the spirit and scope of the invention, as defined by the appended claims and their legal equivalents.

The invention claimed is:

1. A system for driving current to a light source, comprising:

a first inductor to supply current to the light source;

a power source to supply current to the inductor;

a first switch to supply current to the inductor without supplying the current to the light source;

a second switch to supply the current from the inductor to the light source;

a pulse width modulator to control the first switch and the second switch; and an integrator coupled to the pulse width modulator.

2. The system for driving current to the light source as in claim 1, wherein the power source is a battery.

3. The system for driving current to the light source as in claim 1, wherein the light source cooperates with a photo diode.

4. The system for driving current to the light source as in claim 3, wherein the photo diode is coupled to the integrator.

5. The system for driving current to the light source as in claim 4, wherein the integrator is an averaging circuit.

6. The system for driving current to the light source as in claim 1, wherein the light source current is sensed thru switch current.

7. The system for driving current to the light source as in claim 6, wherein the sensed current will be integrated over time and its average is calculated.

8. The system for driving current to the light source as in claim 7, wherein the integrator or average circuit will drive the PWM circuit.

9. A system for driving current to a light source, comprising:

a first inductor to supply current to the light source during the first time period;

a second inductor to supply current to the light source during a second time period;

a power source to supply current to the inductor;

a first switch to supply current to the inductor without supplying the current to the light source;

a second switch to supply the current from the inductor to the light source;

a pulse width modulator to control the first switch and the second switch; and an integrator coupled to the pulse width modulator.

10. The system for driving current to the light source as in claim 9, wherein the power source is a battery.

11. The system for driving current to the light source as in claim 9, wherein the light source cooperates with a photo diode.

12. The system for driving current to the light source as in claim 11, wherein the photo diode is coupled to the integrator.

13. The system for driving current to the light source as in claim 12, wherein the integrator is an average circuit.

14. The system for driving current to the light source as in claim 9, wherein the light source current is sensed thru switches current.

15. The system for driving current to the light source as in claim 14, wherein the sensed current will be integrated over time and its average is calculated.

16. The system for driving current to the light source as in claim 15, wherein the integrator or average circuit will drive the PWM circuit.

17. The system for driving current to the light source as in claim 9, wherein the first inductor and the second inductor can share a magnetic core to form a transformer.

* * * * *